US006264046B1

(12) United States Patent
Ford

(10) Patent No.: US 6,264,046 B1
(45) Date of Patent: Jul. 24, 2001

(54) DISPLAY SYSTEM WITH COLOR CODED STYLES AND SIZES OF MERCHANDISE

(75) Inventor: Allan L. Ford, Melrose Park, PA (US)

(73) Assignee: Reborn Products Co., Inc., Bensalem, PA (US)

( * ) Notice: Subject to any disclaimer, the term of this patent is extended or adjusted under 35 U.S.C. 154(b) by 0 days.

(21) Appl. No.: 09/597,501

(22) Filed: Jun. 20, 2000

(51) Int. Cl.[7] ..... A47F 7/00

(52) U.S. Cl. ..... 211/59.1; 211/85.3; 223/85; 206/459.5; 434/99

(58) Field of Search ..... 211/60.1, 85.3, 211/59.1, 113, 163; 223/85; 206/459.5; 434/99; 40/605, 538

(56) References Cited

U.S. PATENT DOCUMENTS 3,040,448 * 6/1962 Paxton .
3,710,996 * 1/1973 Smilow et al. .
3,978,593 * 9/1976 Pulitzer et al. .
4,253,576 3/1981 Ford et al. .
4,453,655 * 6/1984 Smilow et al. ..... 211/113 X
4,930,692 * 6/1990 Smilow et al. ..... 223/85
5,005,741 * 4/1991 Kolton et al. ..... 223/85
5,487,473 * 1/1996 Ford ..... 211/59.1
5,526,941 * 6/1996 Ford ..... 211/59.1
6,119,875 * 9/2000 Smith ..... 211/59.1

* cited by examiner

*Primary Examiner*—Robert W. Gibson, Jr.
(74) *Attorney, Agent, or Firm*—Caesar, Rivise, Bernstein, Cohen & Pokotilow, Ltd.

(57) ABSTRACT

A merchandise display system having a rack and prong members is arranged for displaying and vending plural articles of merchandise (e.g. belts) of a respective style, with articles of each of these styles being in plural groups of different sizes. A plurality of prong members projecting outward from the base have a first indicium associated therewith, represented by an associated style color. A plurality of hang tags for suspending the articles from the prong members have the same color as the associated style color of the given prong member, for matching the hang tag with a respective prong member. The style colors of the first indicia is used to distinguish by style, origin or price. Each of the hang tags further include a second indicium associated therewith, represented by an associated size color to distinguish the articles by size, each size having a distinctive associated size color. Accordingly, the two indicium of colors are used to segregate the articles on the rack by both style and size.

16 Claims, 2 Drawing Sheets

DISPLAY SYSTEM WITH COLOR CODED STYLES AND SIZES OF MERCHANDISE

FIELD OF THE INVENTION

This invention relates generally to display fixtures, and more particularly to racks for displaying and vending merchandise, such as belts.

BACKGROUND OF THE INVENTION

Belts are commonly vended by suspending them from belt racks. Generally, the belts are arranged on the racks by size, with various styles of belts being co-mingled within a given size. The advantage of displaying belts on a rack, as opposed to packaging them in boxes, is that a customer can view the entire belt and try it on without the necessity of having to remove it from the box. When it is removed from a box, the customer may not necessarily replace it in the box, when placing the box back on a counter.

One of the problems of utilizing earlier types of belt racks is that quite often, customers will remove the belt from its suspending bar, and replace the belt on a different bar. Quite often, the belt is not replaced with belts of a similar size. This creates a major problem for a store attempting to maintain inventory of given sizes of belts, and in addition, it prevents a customer from noticing that a belt in his/her size is available, since he/she will only look at belts on the portion of the rack containing his/her size.

One partial solution to the aforementioned problem has been the provision of a color-coding system for the belts. Utilizing the color-coded system, all of the belts that are on display are provided with a color code which separates belts as to size. For instance, all small belts would be coded brown, all medium belts would be coded yellow, all large belts would be coded red, and all extra large belts would be coded green. In this way, the store can maintain the integrity of the sizes by arranging the belts in their proper colors.

One problem remaining with the aforementioned coding system is that there is no way of segregating the belts as to style. Thus, sport belts, dress belts, fabric belts, etc. will all be co-mingled under a given size. This creates an inconvenience for the customer who is only looking for a particular style of belt. Furthermore, the store has no ready way of maintaining inventory between different styles because all of the styles are co-mingled within a given size range. The store can accordingly have twelve belts of one style in a given size, while only having one belt of a different style in the same size. That problem has been obviated by my earlier invention which is subject of U.S. Pat. No. 4,253,576, now expired, whose disclosure is incorporated by reference herein in its entirety.

That invention comprises a fixture supporting plural belt racks thereon for display in vending. The belt racks comprise a plurality of sections, with each of the sections having indicia thereon, the indicia comprising a different color for each section, each section having a plurality of spokes thereon and a plurality of hang tags for suspending belts from the spokes, with each hang tag in a given section having the same color as the color indicium of the section, and with the colors being used to separate the belts by style. For example, all sport belts would be coded black, all dress belts would be coded blue, and all fabric belts would be coded purple. In this way, the store can maintain the integrity of the styles by arranging the belts in their proper colors.

The one problem remaining with the aforementioned coding system is that there's no system for segregating the belts as to both style and size. Thus, when using a color-coding system where all of the belts that are on display are provided with a color code which separates belts as to size, different styles of belts will be co-mingled under a given size, which creates an inconvenience for the customer who is only looking for a particular style of belt. Likewise, under a color-coding system where all the belts that are on display are provided with a color code which separates belts as to the style, belts of different sizes will be co-mingled under a given style, creating an inconvenience for the customer who is only looking for a particular size, and the customer will only look at belts on the portion of the rack believed to be containing his/her size.

Hence, a need presently exists to provide a fixture for a rack of belts that can be easily segregated as to both style and size.

OBJECTS OF THE INVENTION

Accordingly, it is a general object of this invention to provide a rack for displaying and vending merchandise which substantially overcomes the disadvantages of the prior art.

It is another object of this invention to provide a rack for displaying and vending merchandise that is adapted to separate belts by both size and style.

It is another object of this invention to provide a rack for displaying and vending merchandise which is arranged to be readily mounted on a fixture or other support.

SUMMARY OF INVENTION

These and other objects of this invention are accomplished as a whole, or in part, by providing a display system for displaying and vending articles of merchandise (e.g. belts, ties, socks, suspenders, undergarments, cosmetics, and jewelry) from a fixture or other support. The articles are displayed by the rack in groups of different styles and different sizes.

The rack basically includes a base and a plurality of prong members that project outward from the base. Each projecting prong member has a first indicium (e.g. head portion, depending strap) associated therewith represented by an associated color.

The rack also includes a plurality of hang tags for suspending the articles from the prong members. Each of the hang tags is associated with a given prong member and is the same color as the associated prong member. The associated colors of the first indicia are used to distinguish the article by style (e.g. dress, sport, fabric), origin or price.

Each of the hang tags also has a second indicium (e.g. alphanumeric character) associated therewith. The second indicium is represented by another associated color for distinguishing the article by size, such that each size has a distinctive associated color.

In accordance with one preferred aspect of the invention, the size colors are different than the style colors such that the size colors are distinguishable from the style colors.

In accordance with another preferred aspect of the invention, the second indicia is an alphanumeric character or characters indicative of the size of the merchandise. For example, the character(s) can be a number, (e.g. 30, 32, 34, 36, etc.) or a letter, (e.g. S, "Small"; M, "Medium"; L, "Large"; XL, "Extra-Large", etc.). The second indicia is preferably located at a tab extension of the hang tags so it can be more easily observed.

DESCRIPTION OF THE DRAWINGS

Other objects and many attendant features of this invention will become readily appreciated as the same becomes better understood by reference to the following detailed description when considered in connection with the accompanying drawings, wherein.

DETAILED DESCRIPTION OF THE PREFERRED EMBODIMENT

Figure 1:
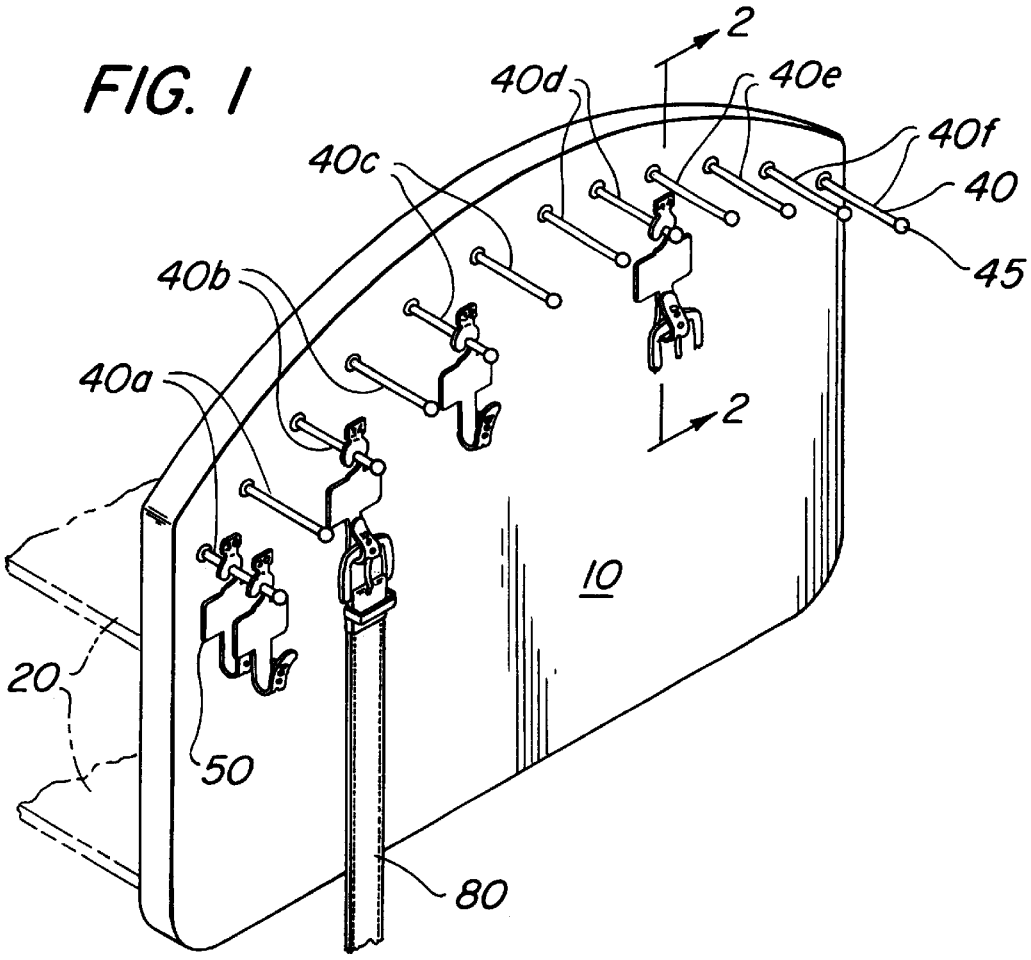
FIG. 1 is a perspective view of the display rack in accordance with a preferred embodiment of the invention.

Referring now in greater detail to the various figures of the drawing, wherein like reference characters refer to like parts, a rack 10 for displaying and vending merchandise constructed in accordance with a preferred embodiment of the present invention is generally shown in FIG. 1. The rack 10 comprises a vertical base and is shown supported by frame-like sections 20 of a conventional fixture in contact with a supporting structure, such as a floor, wall, table, etc.

Figure 2:
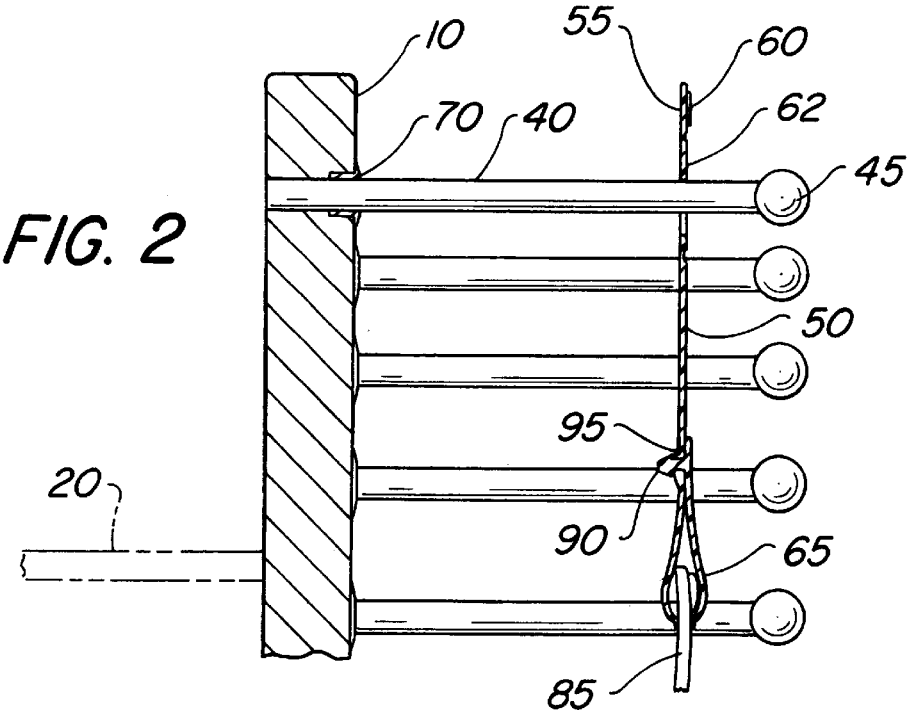
FIG. 2 is an enlarged sectional view taken along line 2—2 of FIG. 1.

Referring to FIGS. 1 and 2, the rack 10 also includes a plurality of parallel and horizontally spaced elongated prongs 40 secured in openings of the base 10, preferably via a grommet 70 aligned adjacent to the inner wall of the openings of the base 10. The grommets 70 are made of hard or flexible material, such as metal or plastic, to protect the openings of the base and to help secure a connecting end of the prong 40 to the base 10. Each prong 40 preferably includes a bulbous free end having an enlarged ball 45 thereon for preventing any of the hang tags, described hereinafter, from accidentally sliding off the free end of the prong 40.

The prongs 40 are provided for suspending belts 80 therefrom, and are shown having a pre-determined color (e.g., red, green, brown, white, gray, pink, etc.) The respective color of each prong 40 is an indication of an associated style, type or origin of the belt (e.g., sport belts, dress belts, fabric belts, "designer" named dress belts, texture surface belts to replicate particular animal skins e.g., snake-skin).

Preferably, the entire visibly exposed prong 40 is shown having the pre-determined color. However, predetermined portions of the prong 40 could be in the pre-determined color while other portions of the prong 40 are in another color. For instance, the enlarged ball 45 of each prong could display the predetermined color, while the elongated stem of the prong has a neutral color. In this example of the preferred embodiment, if only the enlarged balls 45 are shown with their respective pre-determined colors, then the style indicia of each prong 40 can be set by placing an enlarged ball 45 having the desired color onto the respective prong 40. Further, the style indicia of each prong 40 can be changed simply by switching the enlarged ball 45 from the respective prong with a desired, colored, enlarged ball 45.

Preferably, the entire prong is molded as an integral unit of a predetermined colored plastic. Alternatively, the enlarged ball 45 of the prong 40 may be frictionally attached to the stem of the prong 40 by screwing or pushing the enlarged ball 45 onto the stem of the prong 40. Likewise, the enlarged balls 45 are removed by unscrewing or forcibly pulling the enlarged ball 45 off the stem. The enlarged ball 45 may also be secured onto the stem of the prong 40 with glue or epoxy resin.

While the prongs 40 shown in FIGS. 1 and 2 appear with the same shading, it is understood that each prong 40 may have a different color as an indication of the respective style, type or origin of the belt 80 to be displayed hanging from the prong 40. For example, prongs 40*a* may be yellow, prongs 40*b* may be brown, prongs 40*c* may be green, prongs 40*d* may be purple, prongs 40*e* may be blue, and prongs 40*f* may be red, respectively. Thus, in this example of the preferred embodiment of this invention, six different styles of belt are displayed from the rack 10, with each style represented by a corresponding prong color. While in this example, two adjacent prongs 40 are used for displaying each style of belt 80, a skilled artisan would readily understand that the number of prongs 40 used for representing each style can vary according to the vendor's needs and the number of belts 80 of each style that will be displayed at a given time. Thus, if, for example, the vendor has 24 interwoven belts, and each prong 40 can support up to 6 belts, then at least 4 prongs 40 having the same color would be needed for displaying the 24 belts. Accordingly, the number of prongs 40 having a predetermined color would depend upon the number of belts 80 of the style corresponding to that color. Further, the shape of the rack 10 and number of prongs 40 used for displaying the belts 80 can vary according to vendor needs or desires.

Figure 3:
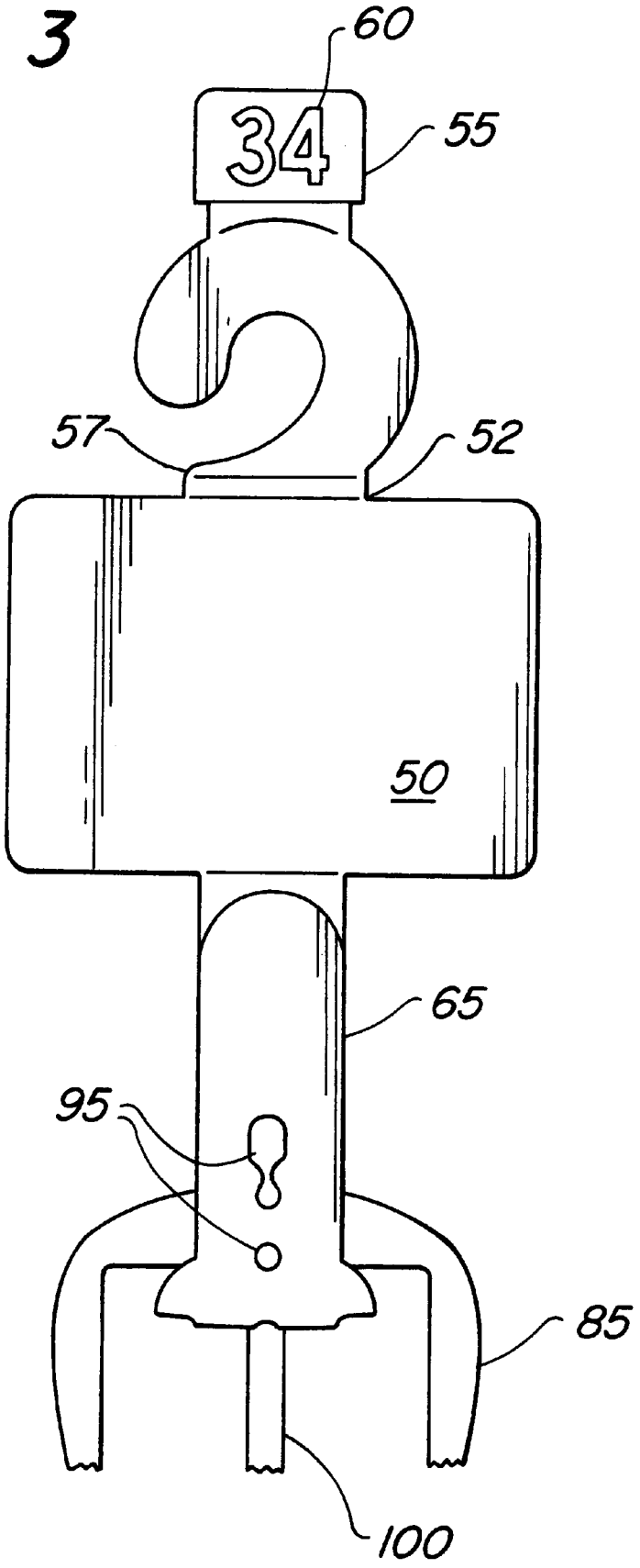
FIG. 3 is an enlarged perspective view showing a hang tag and a portion of a belt adapted to be placed thereon.

The belts 80 are releaseably mounted on the rack 10 through the use of hang tags 50, such as that generally shown in FIGS. 2 and 3. Each hang tag 50 is of a generally conventional construction, e.g., is molded of a flexible, colored plastic material, and basically comprises a head 52 and an integral depending strap 65. Strap 65 is an elongated member which is arranged to be extended through a buckle 85 of a belt 80, bent back onto itself and snap-connected to itself with a nib 90 having an enlarged head for snap insertion into an opening 95 of the depending strap 65, to releaseably suspend the belt 80 therefrom. The depending strap 65 also includes openings 95 for receiving and holding the buckle tongue 100. The head 52 of the hang tag 50 includes a slot 57 for receiving a prong 40 to suspend the hang tag 50, and the belt 80 connected thereto, from the prong 40.

The head 52 of the hang tag 50 further includes an upstanding projection 55 bearing an alphanumeric character 60 indicating the size of the belt 80 suspended from the hang tag 50. The hang tag 50 shown in FIG. 3 includes the projection 55 bearing the character "34" to indicate that the belt 80 suspended therefrom is size 34. In a preferred embodiment of this invention, the character 60 indicating the size of the belt 80 is shown in a color indicating the size of the belt 80. For example, the character 60 is shown in a predetermined color (e.g. gold) to indicate that the belt 80 suspended from it is a size corresponding to the predetermined color (e.g. gold), such as size 34, or "S", which stands for "Small".

Each size of belt 80 has a predetermined corresponding color, for example, charcoal, black, gold, white, teal, purple, etc. In a preferred embodiment, the size indicia is selected from a group of colors that are different from the colors used as indicia of the style of the belt 80 so that the color of the character 60 is not lost or merged into the color of the bang tag 50. In this way, a store has the benefit of maintaining the integrity of the sizes of the belts 80 by arranging them in their proper colors based on the size color indicia shown on the hang tag 50.

Once a belt 80 has been secured and placed on its hang tag 50, the belt 80 can then be placed on its appropriate prong 40. This is accomplished by first determining the style of the belt 80, so that the belt 80 can be placed on the rack 10 with the other belts of that same style. This is readily determined by comparing the color of the hang tag 50 with the colors of the prongs 40 on the rack 10. Thus, there will be a separate color hang tag 50 for each style of belt 80 and a correspondingly colored prong 40 on the rack 10 for suspending that belt 80. For instance, if the belt 80 is a reversible belt, the hang tag 50 may be yellow to represent the style (reversible) of the belt 80. The belt 80 is placed on the yellow hang tag 50 by the retailer of the belt 80. In particular, to that end, the person filling the rack 10 in the retail store will simply look at the color of the hang tag 50 and the color of the character 60 on the projection 55, and noting that the color of the hang tag is yellow, and the color of the size indicia is gold, will place the belt 80 on the yellow prong 40*a* for the appropriate size indicia (e.g. gold for "34") of the belt 80 on the rack 10. Thus, if the belt is size 34, it will be suspended by its hang tag 50 having a gold size indicia from the yellow prong 40*a* of the rack 10, with other belts 80 of the same style and size. Belts 80 of other styles, such as those suspended by brown hang tags 40, are mounted on the brown prongs 40*b* according to their size indicia in the same manner as described heretofore. All the other belts 80 are added to the rack 10 in a similar manner.

When all the prongs 40 are filled with belts 80, the fixture 5 has a full, aesthetically pleasing appearance, with matching colored prongs and hang tags, and matching colored size indicia arranged together.

The sizes for the belts may be marked in inches, centimeters or other conventional size designations, such as S, M, L and XL, which stand for "Small", "Medium", "Large", and "Extra-Large", accordingly. Typically, for men's belts, a "Small" size covers a belt ranging in size from 30 to 32 inches (76.2 to 81.3 centimeters), a "Medium"size belt covers a belt ranging in size from 34 to 36 inches (86.4 to 91.4 centimeters), a "Large" size belt covers a belt ranging in size from 38 to 40 inches (96.5 to 102 centimeters) and an "Extra-Large" size belt covers a belt ranging in size from 42 to 44 inches (107 to 112 centimeters).

When a retailer desires to restock a rack 10, the retailer will first be certain that all of the hang tags 50 are placed in their appropriate region of the rack 10. Thus, all yellow hang tags 50 should be placed within the region formed by yellow prongs 40. The retailer will go through the same routine with other style color indicia to be certain that all of the belts 80 of a given style are placed in their proper regions. Thereafter, all of the belts 80 will be arranged on their appropriate prong 40 according to their size color indicia so that all of the belts 80 of a given size can be counted.

Once the arrangement has been carried out, the store owner can then readily determine the number of belts 80 in each size for each style, and can readily restock each rack 10 accordingly. The entire process of arranging the display, taking an inventory and restocking the display can be carried out in only a few minutes. The sizes of the belts 80 for any given style are easily determined, since they appear in the projection 55 of the hang tag 50 according to a predetermined color, and are readily visible, as is apparent from FIG. 3.

The belts 80 are easily placed on the rack 10 or removed therefrom. In order to place the belt 80 on a prong 40, the hang tag 50 is held beside the prong 40 and moved to the left. The prongs 40 will enter the slot 57, and when the hang tag 50 is released, the prong 40 will be engaged in a notch of the hang tag 50. The enlarged balls 45 at the ends of the prongs 40 prevent the belts 80 from inadvertently sliding off their associate prongs 40. However, a customer wanting to try on or view a particular belt 80 merely has to lift the hang tag 50 and pull it to the right in order to remove it from the prong 40. If the customer does not purchase the belt 80, he/she can easily replace the belt 80 on the prong 40 in the same manner as is done when stocking the belt 80, as described above. If the belts are mishung by customers, personnel of the retailer can readily rehang the belts according to their color coding.

A number of belts 80 have been shown in FIGS. 1 and 2 by way of example. For the purpose of clarity, belts 80 have not been shown as being suspended from all of the prongs 40. However, it should be understood that during use of the rack 10, belts 80 can be suspended from all of the prongs 40. Moreover, while each prong 40 is shown including an enlarged ball 45 at its free end, it is understood that in lieu of or in addition to the enlarged ball 45, each prong 40 could include an upwardly bent free end for preventing the hang tags 50 from accidentally sliding off the prong 40.

As an optional feature of the invention, all the belts 80 associated with a predetermined color can also be of the same origin or price, as well as being of the same style. Thus, the customer can shop for desired belts by manufacturer or price, as well as shopping for them by style.

It should be apparent from the aforementioned description and attached drawings that the concept of the present application may be readily applied to a variety of preferred embodiments, including those disclosed herein. For example, instead of displaying the character 60 in the second indicia, the projection 55 may be displayed as the second indicia. Without further elaboration, the foregoing will so fully illustrate my invention, that others may, by applying current or future knowledge, readily adapt the same for use under various conditions of service.

I claim:

1. A system for displaying and vending articles of merchandise, the articles being in groups of different styles and different sizes, said system comprising:

a base;

a plurality of prong members projecting outward from the base, each prong member having a first indicium associated therewith represented by an associated style color; and a plurality of hang tags being arranged for suspending the articles from the prong members, with each of the hang tags associated with a given prong member and having the same color as the associated style color of said given prong member, with the associated style colors of the first indicia being used to distinguish the articles by style or origin, each of said hang tags further having a second indicium associated therewith, represented by an associated size color, to distinguish the merchandise by size, such that each size has a distinctive associated size color.

2. The system of claim 1, wherein the size colors are different that the style colors.

3. The system of claim 1, wherein the articles include at least one of belts, ties, socks, suspenders, undergarments, cosmetics and jewelry.

4. The system of claim 1, wherein said second indicia has a shape indicative of a size of the article.

5. The system of claim 4, wherein said shape is a number.

6. The system of claim 4, wherein said shape is a letter.

7. The system of claim 1, wherein said second indicia is located at a tab extension of the hang tags.

8. The system of claim 1, wherein each prong member includes a connecting end connected to said base, a distal end having a stopper for preventing a hang tag from accidentally sliding off said prong member, and a center section there between.

9. The system of claim 8, wherein said distal end is spherical.

10. The system of claim 8, wherein said connecting end is connected to said base via an opening in said base.

11. The system of claim 10, further comprising a grommet frictionally aligned adjacent to an inner peripheral wall of said opening for receiving said connecting end.

12. The system of claim 8, wherein said distal end is the associated style color for representing said first indicium.

13. The system of claim 8, wherein said center section is the associated style color for representing said first indicium.

14. The system of claim 1, wherein said prong members are elongated linear members extended substantially perpendicular to said base and substantially parallel to each other.

15. The system of claim 1, wherein said second indicia is located at the top of each hang tag, so it is readily visible.

16. The system of claim 1, further comprising a support connected to and securing the base in a vertical position.

* * * * *